US006350348B1

(12) United States Patent
Henricson et al.

(10) Patent No.: US 6,350,348 B1
(45) **Date of Patent: *Feb. 26, 2002**

(54) BATCH COOKING WITH BLACK LIQUOR PRETREATMENT

(75) Inventors: Kaj Henricson, Helsinki; Auvo Kettunen, Neuvoton; Hannu Ramark, Kotka, all of (FI)

(73) Assignee: Andritz-Ahlstrom Oy, Helsinki (FI)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/341,843

(22) PCT Filed: Jan. 22, 1998

(86) PCT No.: PCT/FI98/00054

§ 371 Date: Jul. 19, 1999

§ 102(e) Date: Jul. 19, 1999

(87) PCT Pub. No.: WO98/32912

PCT Pub. Date: Jul. 30, 1998

(30) Foreign Application Priority Data

Jan. 22, 1997 (FI) ..... 970254

(51) Int. Cl.[7] ..... D21C 3/26

(52) U.S. Cl. ..... 162/19; 162/17; 162/29; 162/33; 162/37; 162/39; 162/42; 162/47; 162/57; 162/63; 162/43

(58) Field of Search ..... 162/19, 17, 29, 162/33, 37, 39, 42, 47, 57, 63, 43

(56) References Cited

U.S. PATENT DOCUMENTS

| | | | | |
|---|---|---|---|---|
| 2,639,987 A | | 5/1953 | Sloman | |
| 5,635,026 A | * | 6/1997 | Kettunen et al. | 162/19 |

FOREIGN PATENT DOCUMENTS

| | | |
|---|---|---|
| EP | 0 520 452 | 12/1992 |
| WO | WO 91/12368 | 8/1991 |
| WO | WO 95/23891 | 9/1995 |
| WO | WO 96/02698 | 2/1996 |
| WO | WO 96/07786 | 3/1996 |

* cited by examiner

*Primary Examiner*—Stanley S. Silverman
*Assistant Examiner*—Mark Halpern
(74) *Attorney, Agent, or Firm*—Nixon & Vanderhye P.C.

(57) ABSTRACT

A method of cooking pulp in an alkaline batch process (using one or more batch digesters) improves pulp bleachability. The wood material is supplied to the digester; the cellulosic material is pre-treated in the digester with a first liquor, the first liquor is displaced by a second liquor, the displaced first liquor is led to a further treatment, the cellulose material is treated with the second liquor, and the cooked pulp is removed from the digester. The second liquor is displaced as two consecutive parts, i.e. as strong black liquor and weak black liquor, and after cooling in a heat exchanger the strong black liquor thus obtained is fed into the digester as the first liquor in a subsequent batch (in the same, or a different, batch digester).

28 Claims, 8 Drawing Sheets

BATCH COOKING WITH BLACK LIQUOR PRETREATMENT

CROSS-REFERENCE TO RELATED APPLICATION

This is a U.S. National Phase of PCT/FI98/00054 filed Jan. 22, 1999.

BACKGROUND AND SUMMARY OF THE INVENTION

The present invention relates to a method and apparatus for cooking comminuted cellulosic fibrous material to produce cellulosic pulp. Especially preferably, the invention relates to an alkaline batch cooking process, i.e., to a so called Batch cooking process.

Alkaline cooking processes, in particular the sulphate or kraft process, have conventionally been performed in such a way that the wood matter, i.e. the chips, and the cooking liquor are added into a cooking vessel, the temperature of which vessel is then raised to the cooking temperature for a given period of time, whereby lignin is detached from the wood matter, the end result being chemical pulp and waste liquor. In the sulphate process, white liquor, i.e., a mixture of the active cooking chemicals sodium hydroxide (NaOH) and sodium sulfide (Na2S), is used as the cooking liquor. The concentration of the active cooking chemicals is typically given in terms of "effective alkali" (EA) expressed as g/l as equivalent NaOH. The waste liquor is typically referred to as "black liquor" which contains some amount of residual cooking chemicals, usually below 10 g/l EA as NaOH as well as dissolved wood material.

Modifications have been made to the conventional batch sulphate process, including the known SUPERBATCH and RDH batch cooking processes. By reusing waste liquor, i.e. black liquor, generated in the cook a good heat economy and a low cooking Kappa number can be achieved with these processes. However, mainly due to the reuse of the black liquor, the processes involve a great problem, namely inferior bleachability of pulp, that is, the pulp produced by these processes typically requires more bleaching chemical to obtain a comparable brightness compared to pulps produced from other methods.

In a cooking method according to our invention, it has been possible to eliminate the problem of bleachability by further development of the kind of process mentioned. This has resulted above all in better bleachability, but in addition, the yield and relative strength of the pulp has also improved. It has been noted that the actual problem is the dissolved organic material contained in the black liquor, in other words, the organic material which is dissolved from the wood matter and enters into the liquor. In modified batch processes mentioned above, organic material is typically returned both to the pre-treatment and the actual cook to such an extent that the pulp produced has inferior bleachability, yield and strength compared to the pulp produced by the present invention.

Said problem has been removed by a method according to the present invention, which method comprises the steps of supplying the wood matter into the digester; pre-treating the wood matter in the digester with a first liquor; displacing the first liquor by a second liquor; directing said displaced first liquor to a further treatment; treating the wood matter with the second liquor; displacing the second liquor with a wash liquid; and removing the cooked pulp from the digester; and which is characterized by such a displacement of the second liquor that a strong black liquor BLS is obtained, having an alkalinity of 15–40 g/l as NaOH, and by the supply of strong liquor obtained in this way into the digester at a temperature of below 140° C., preferably below 130° C., and most preferably below 120° C.

Another embodiment of this invention consists of a method of cooking comminuted cellulosic fibrous material to produce cellulose pulp in one or more batch digesters, consisting of the following steps: a) introducing the material to the digester; b) introducing a first liquor (BLS) having a first effective alkali concentration to the digester; c) treating the material in the digester with the first liquor; d) displacing the first liquor from the digester with a second liquor (WL/BLW) having a second effective alkali concentration, to produce a third liquor, displaced from the digester, having a third effective alkali concentration lower than the first effective alkali concentration; e) treating the material in the digester with the second liquor(WL/BLW); f) displacing the second liquor from the digester with a fourth liquor (W) having a fourth effective alkali concentration, lower than the third alkali concentration, to produce a fifth liquor, displaced from the digester, having a fifth effective alkali concentration, lower than the second effective alkali concentration; and g) removing the treated material from the digester; characterized in that the fifth liquor (BLS) has a fifth effective alkali concentration of between 15–40 g/l, preferably, between 20–35 g/l, most preferably, between 25–35 g/l expressed as NaOH and the fifth liquor comprises at least some of the liquor used as the first liquor in step (b).

In a preferred embodiment the fifth liquor is cooled to a temperature below 140° C. prior to its use as the first liquor in step (b). The temperature of the fifth liquor (BLS) may be even cooler, for example, below 120° C. or even between 80–100° C. This fifth liquor may be cooled by passing it in heat exchange relationship with a sixth liquor, for example, white liquor (WL) or weak black liquor (BLW), which can be used individually or in combination as the second liquid or the fourth liquid.

The fourth liquid (W) may be washer filtrate, condensate or any other liquid stream having low alkali content (that is, less than 5 g/l as NaOH) and low dissolved organic content.

The third effective alkali concentration of the third liquor, that is the liquor displaced by the second liquor in step (d) is typically less than 10 g/l, as NaOH and can be less than 5 g/l as NaOH. The duration of step (c) is typically between 20–120 minutes, preferably between 30–90 minutes.

The method described above may also include an additional step (h) between steps (f) and (g) wherein a seventh liquor (BLW) is displaced from the digester by the fourth liquor (W) after the fifth liquor (BLS) is displaced. This seventh liquor (BLW) will have a sixth effective alkali concentration which will be less than the fifth alkali (BLS) concentration. This seventh liquor (BLW) may be used with the fifth liquor (BLS) for the first liquor in step (b) or with the second liquor (WL) of step (d) or both.

The present invention also includes an apparatus for performing a batch cooking process, comprising several digesters (10) and means (12, 14, 16, 18, 26, 28, 42, 48, 50, 62, 70) for storing and recirculating different liquors in the process, characterized in that the apparatus further comprises means (20, 40, 60, 66) for cooling the liquor displaced from the digester (10) prior to the supply of the liquor into the digester (10) and prior to the raising of the temperature in the digester. The cooling means may be a heat exchanger (20, 40, 60) or a flash tank (66). The heat exchanger (20, 40, 60) may be connected to a pipe line (26, 64) between a liquor tank (12) and the digester(10). The heat exchanger (20) may also be connected to a pipe line (46) between the digester (10) and the liquor tank (42). The heat exchanger (60) may also be connected to a pipe line (64) between a liquor tank (62) and the flash tank (66). The flash tank (66) may be connected by a pipe line to a steaming vessel (68) or a chip hopper. The apparatus may further comprise a pump (74) arranged in connection with the chip hopper or steaming vessel, by means of which pump the chips are transferred into the digester (10).

BRIEF DESCRIPTION OF THE DRAWINGS

Other characterizing features of the method and apparatus according to the invention become obvious from the appended claims.

In the following, the method according to the invention is explained in more detail with reference to the appended figures, of which

DETAILED DESCRIPTION OF THE DRAWINGS

Figure 1:
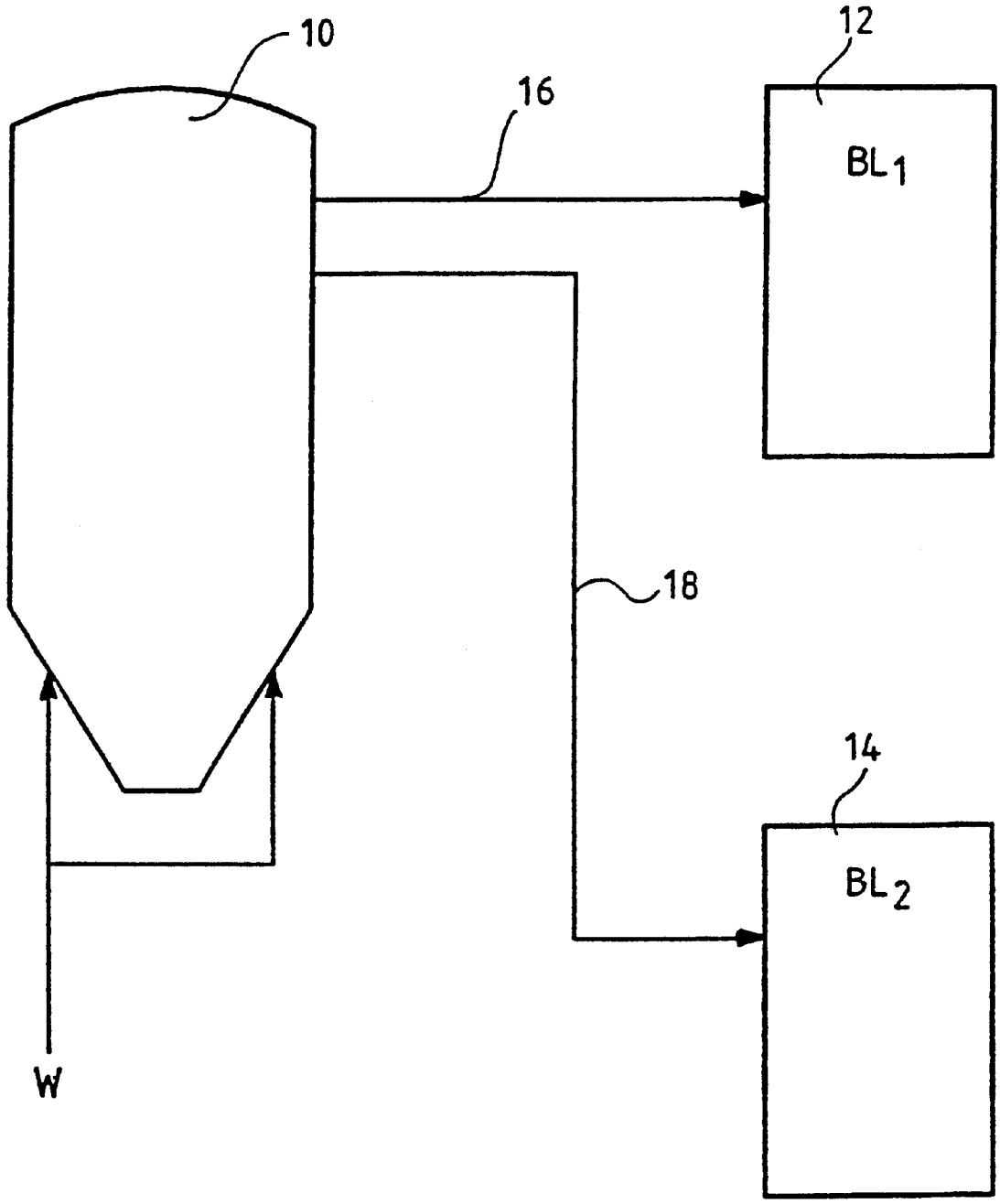
FIG.1 (Prior Art)
FIG. 1 illustrates a batch cooking process according to prior art from the point of view of the recovery of liquors.

In a conventional batch process according to the prior art, as shown in FIG. 1, the pulp is cooked in a digester 10, into which wash liquid W is supplied at the final stage of the cook, by means of which wash liquid the displacement of liquids is performed in the digester 10. An object of the prior art is to remove the black liquor BL generated during the cook by displacing it with a wash liquid W, which is most often a weaker black liquor filtrate from the pulp wash department. Two different black liquors, BL1 and BL2, are generated in the displacement and used in the way described in the prior art.

In the following, a method according to our invention is dealt with in such a way that the conventional way to reuse black liquor is described first and then it is explained how this process can be improved in a surprising way. The improvement of the process is based on a deeper insight into the significance of the reactions. Contrary to conventional thinking, we have discovered that in fact, sulphur has not a key role in the reuse of black liquor.

In the prior art displacement illustrated in FIG. 1, hotblack liquor BL1 at a temperature close to the cooking temperature (the cooking temperature in the digester 10 being normally 155–170° C.) is displaced/removed first. The temperature of the displaced liquor at the beginning of the displacement is between 170–140° C. and it keeps decreasing during the displacement as the hotter spent cooking liquor is displaced by the colder wash liquor W. Thus, black liquor BL1 at an average temperature of 140–170° C., typically of 150–160° C., is gathered in the hot black liquor tank 12 via the pipeline 16.

As the displacement continues, the temperature of the black liquor displaced from the digester 10 drops further, and generally at the phase when the temperature has dropped below approximately 130–140° C., black liquor BL2 begins to be directed via the pipeline 18 into a cold liquor tank 14. At the end of the displacement, the temperature drops to near 100° C. or even below that. The temperature of the displacing liquor is usually 80–100° C., typically about 90–100° C. Hence, the temperature having dropped to near 100° C., the displacement in the digester 10 has proceeded rather far and the discharged liquor BL2 contains quite a lot of displacing liquor W.

Figure 2:
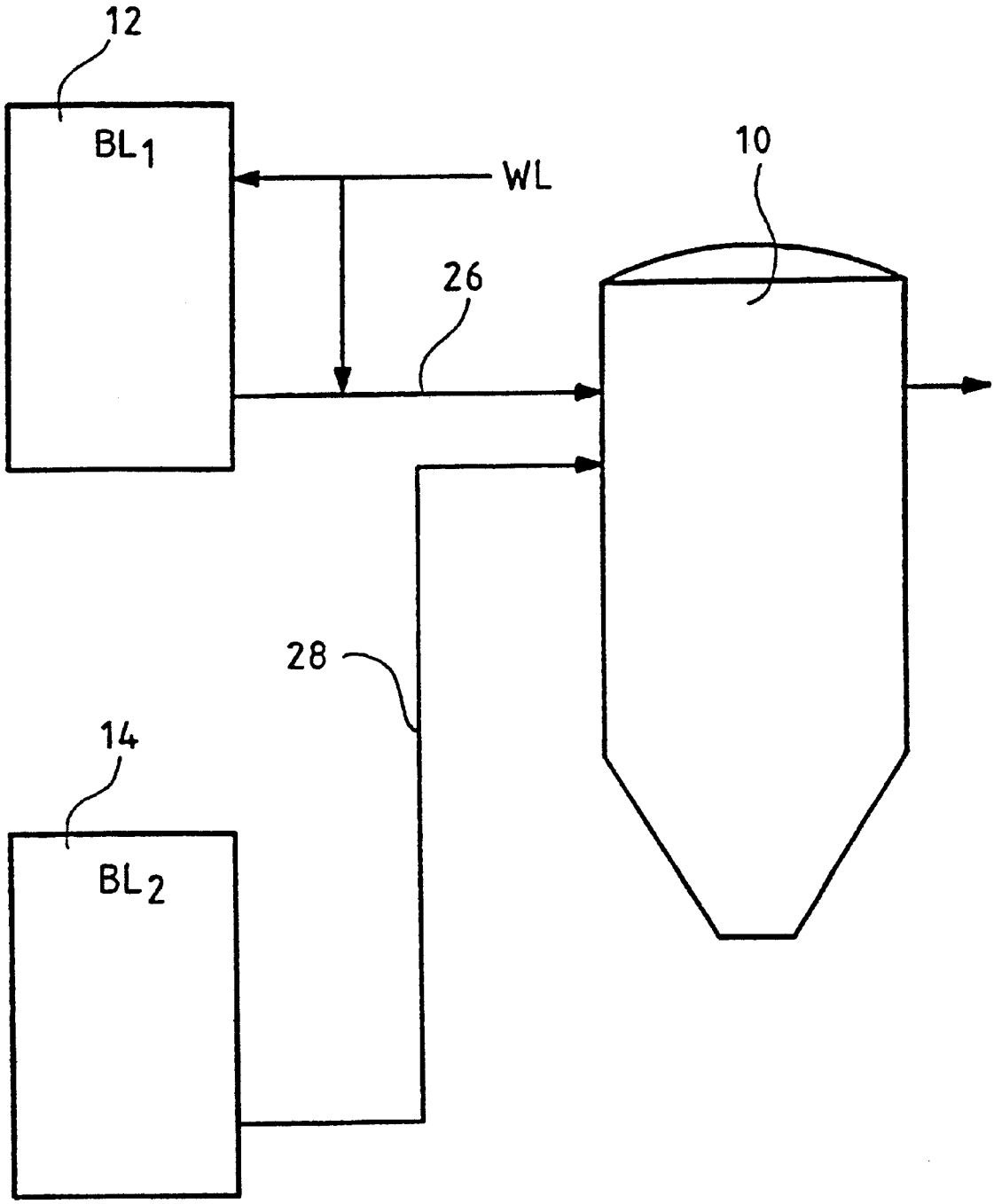
FIG. 2 (Prior Art)
FIG. 2 illustrates a batch cooking process according to prior art from the point of view of the reuse of liquors.

In the prior art processes processes, the black liquors in tanks 12 and 14 are reused in the cook according to FIG. 2. At the beginning of the cook, the wood (in the form of chips) is supplied into a digester 10 and after that, black liquor BL2 is brought therein from the cold liquor tank 14 via a pipeline 28. According to the prior art, the significance of the black liquor BL2 taken from the tank 14 is two-fold. First, liquor BL2 pre-heats the wood to the temperature of 80–100° C., and second, the sulphur contained in BL2 penetrates the wood, as described by Olm in an article entitled *Pretreatment of Softwood with Sulfide-containing Liquor prior to Kraft Cook* published in Tappi 1994 Pulping Conference, for example. Thus, the object of the first treatment has according to the prior art been to pre-heat chips and to treat the chips with the sulphur in the black liquor BL2. This treatment usually takes 15–30 minutes.

In prior art methods, the treatment is hereafter carried on with hot black liquor BL1 from the tank 12. Hot black liquor is taken from the tank 12 into the digester 10 via the pipeline 26, and used to displace the colder black liquor therein originating from the tank 14. Thus, the temperature in the digester can be raised to the range of 140–160° C. when black liquor BL1 is introduced. This is relatively close to the cooking temperature (i.e., 150–180° C.) and only a small amount of fresh steam is required for the final heating to cooking temperature. The actual cooking liquor WL (white liquor) is supplied into the hot liquor tank 12, or alternatively directly into the pipeline 26 leading from the hot liquor tank 12 to the digester 10.

Thus, it has been believed that this is a cooking method combining a good heat economy and a pre-treatment with sulphur. The disadvantage of the method has, however, been the poor bleachability. According to the understanding of the present inventors, this is because there is, due to the black liquor treatments, a very large amount of dissolved dry matter in the cook. The significance of the presence of this dry matter, also known as "dissolved organic material", on the properties of the resulting pulp and the desirability of reducing the concentration of this matter during a kraft cook are disclosed in U.S. Pat. Nos. 5,489,363; 5,536,366; 5,547,012; and 5,575,890, among others. The processes described in these patents are sold under the trademark LO-SOLIDS® by Ahlstrom Machinery, Glens Falls, N.Y., USA.

There have been attempts to solve the bleachability problem by adding part of the white liquor WL to other points of the cooking process. In some prior art cooking processes, part of the white liquor WL has been added into the pipeline 28 leading from the cold black liquor tank 14 to the digester, or into the tank 14, but in spite of these measures, the bleachability of pulp has been inferior.

For example, published PCT application WO 95/23891, discloses a modification to the RDH® batch cooking process which is marketed by Beloit Technologies Inc. In the RDH process, the chips in the batch digester are sequentially treated with cool black liquor (70–90° C.), then warm black liquor (90–150° C.) and then hot black liquor (150–168° C.). In the conventional RDH process fresh cooking liquor, that is, white liquor, is only introduced during the treatment with hot black liquor. The modified process disclosed in WO 95/23891 also proposes adding white liquor to the cool and warm black liquor treatments. Thus, the process proposed in WO 95/23891 includes three stages of black liquor treatment, in each of which fresh cooking chemical is introduced. The inventors of the present invention have found that pulps having improved properties, that is, bleachability, strength and yield can be produced by using only a single black liquor treatment stage. In addition to requiring only a single black liquor treatment stage, the black liquor treatment in this single treatment of the present invention is performed at a much cooler temperature than the high alkalinity black liquor treatment of the WO 95/23891 process. Also, the cool liquor treatment of the present invention is performed at a much higher alkalinity than the cool liquor treatment of the process disclosed in WO 95/23891.

Published PCT application WO 96/02698 proposes a process similar to the process described in WO 95/23891. The WO 96/02698 process also seeks to improve the sulfate batch cooking process by introducing fresh kraft cooking liquor to all the stages of cooking. The WO 96/02698 process proposes only two cooking stages: the first in which the chips are treated with fresh cooking chemical and spent cooking liquor (that is, black liquor ) and a second in which the chips are treated with fresh cooking liquor and wash liquor. Contrary to the present invention, the process of WO 96/02698 introduces fresh cooking chemical with the black liquor to the first stage of cooking and also performs the first treatment at a much higher temperature (160–180° C.) compared to the present invention. The first stage of the WO 96/02698 process is clearly a "cooking" process at such high temperatures, where the black liquor treatment of the present invention is clearly a pre-treatment prior to formal cooking.

Among other distinctions, these two PCT publications disclose processes which increase the consumption of cooking chemical by introducing fresh cooking chemical where it is not needed and they increase the potential to deteriorate the quality of the pulp produced by treating the chips with spent cooking liquors at unnecessarily high temperatures. The present invention overcomes the disadvantages of this prior art while providing an alkalinity profile that produces improved yield, strength and bleachability while minimizing the consumption of fresh cooking chemical.

Figure 3:
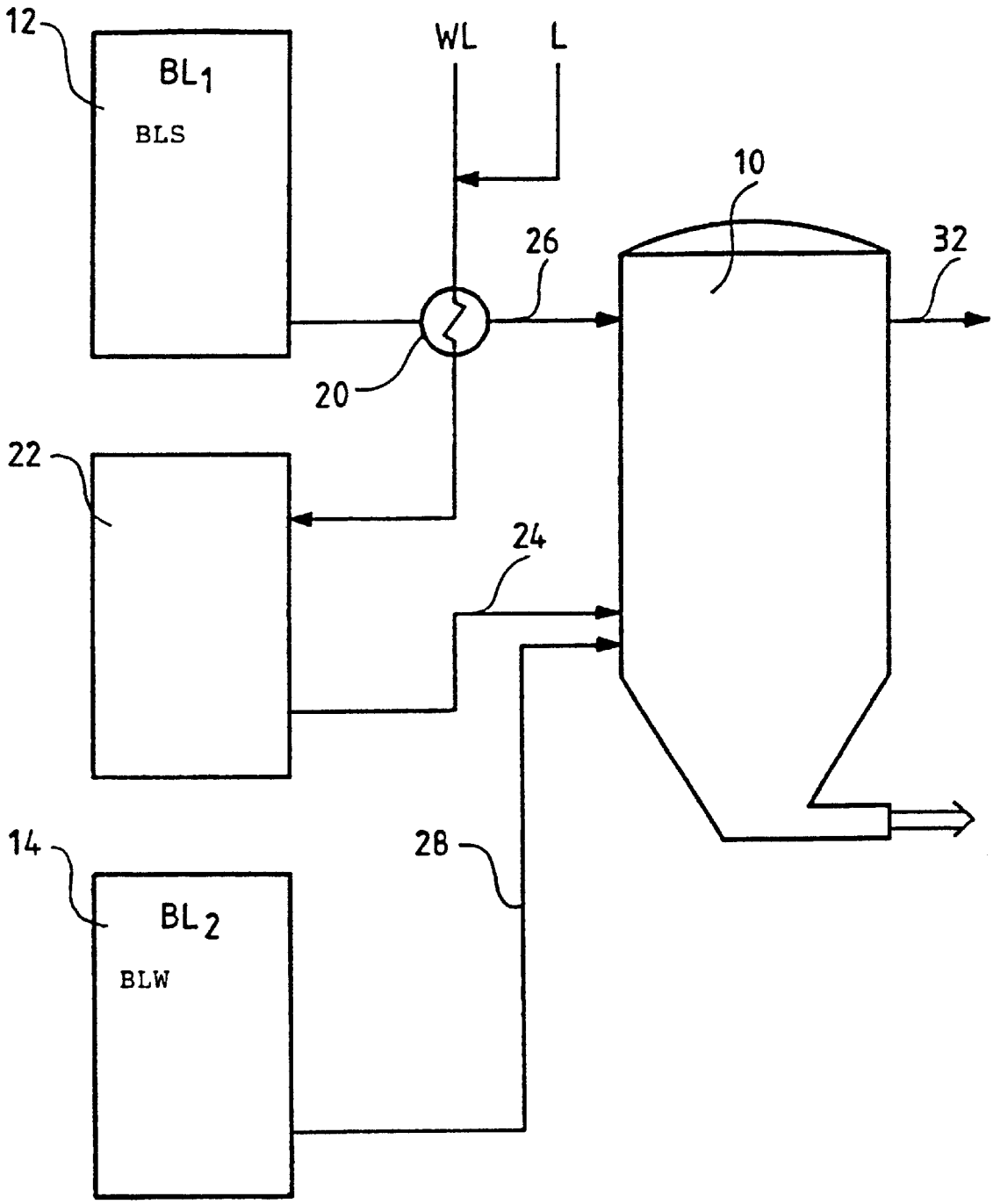
FIG. 3 schematically illustrates a batch cooking process according to a preferred embodiment of the invention.

FIG. 3 illustrates a method according to our invention, by means of which method increased yield, strength and bleachability can be achieved in a alkaline batch cooking process compared to the prior art processes. It is characteristic of the method according to our invention that the black liquor BL1 is displaced from the digester 10 into the hot liquor tank 12, the residual alkali of which black liquor is 15–40 g/l NaOH, preferably 20–35 g/l, most preferably 25–35 g/l, expressed as NaOH. This black liquor BL1 (also referred to as strong black liquor, BLS) is preferably cooled by means of a heat exchanger 20 to a temperature below 140° C., preferably below 130° C., and more preferably yet below 120° C. prior to being re-introduced to the same or different digester 10. The heat exchanger 20 also heats the white liquor WL, or other liquid L, prior to its being introduced to digester 10. The temperature of the liquid to be heated is raised to above 130° C., preferably above 140° C.

In the following, the method according to the invention is explained in more detail with reference to FIGS. 1 and 3. At the end of the cook, as there are still a large amount of cooking chemicals present, the cooking is finished by starting the displacement by bringing wash liquid W see FIG. 1 into the digester 10 as displacement liquid. According to the present invention, at the beginning of the displacement, there is discharge of hot liquor BLS having a high alkalinity, i.e. 15–40 g/l, preferably 20–35 g/l, most preferably, 25–35 g/l effective alkali, expressed as NaOH. The temperature of this liquor is 140–170° C. The liquor BLS is led via the pipeline 16 into the hot liquor tank 12, see FIG. 1. After this, the displacement continues in a conventional way, producing cold weak black liquor BLW having a relatively low alkalinity, that is, an EA below 20 g/l, typically 5–15 g/l, as NaOH. The weak cold liquor BLW is taken via the pipeline 18 into the cold liquor tank 14.

The strong and hot residual liquor BLS obtained in the above-described manner is reused in such a way that both the heat and the residual chemicals can be made use of. In accordance with FIG. 3, the heat is recovered by means of a heat exchanger 20, in which the temperature of the liquor is dropped below 140° C., preferably below 130° C., and more preferably yet below 120° C. The heat exchanger 20 may be positioned for example in a line 26 downstream of the hot liquor tank 12, or in a line 16 (illustrated in FIG. 1) upstream of the tank. Hence, the tank 12 would more accurately be called a strong liquor tank. It is preferable to cool the strong liquor before introducing it to tank 12 also for the reason that effective alkali would thus not be consumed for secondary reactions in the tank.

In the heat exchanger 20, the heat is preferably transferred to the white liquor WL, but may as well be transferred to any liquid L which is led to the digester 10. This kind of liquid may be for example a weak cold black liquor BLW, when it is brought to the digester to adjust the liquid/wood ratio.

The actual cooking is carried out by using strong liquor BLS from the tank 12, white liquor WL, preferably preheated white liquor WL from the tank 22, and cold black liquor BLW from the tank 14.

To our surprise, we have discovered tKAt the pretreatment with weak liquor BLW to tie the sulphur into the wood is not important when the cooking is finished with a large amount of residual alkali, as described above. Therefore, this stage in the cooking process may be left out and the cooking may be started by filling the digester with wood/chips, after which the strong liquor BLS is supplied via the pipeline 26 directly to the digester. The pre-treatment with strong liquor BLS is performed at a temperature of 80–100° C., preferably about 90° C. During the pretreatment, the alkalinity of the liquor drops to the level below 10 g/l, preferably to the range of 5–10 g/l (as effective alkali). This takes 20–120 minutes, usually 30–60 minutes.

Often, there is not sufficiently strong liquor BLS and therefore it is necessary to use some weak liquor BLW from the tank 14 to fill the digesters. In addition, other additional chemicals, such as green liquor, white liquor, polysulphide, anthraquinone or other chemicals promoting the cooking or improving the chemical composition may be brought to this first treatment stage.

During the first treatment, active chemicals of strong liquor BLS are consumed and simultaneously a sufficient amount of sulphur is tied into the wood. At this stage, 15–20% wood matter, mainly something else than lignin, is dissolved from the wood.

After the first treatment stage, the white liquor WL is supplied from the tank 22 via the pipeline 24 into the digester 10 by displacing black liquor from the digester 10. The white liquor WL having been pre-heated by means of a heat exchanger 20, efficient heat recovery is achieved. Generally, the temperature rises at this stage to the temperature of 140–160° C. Also, some weak liquor BLW is often added through the pipeline 28 or 30 (30 not shown in Figures). The amount of white liquor to be added is in this displacement stage 50–100% of the white liquor amount used in the whole cook. After the white liquor displacement, the temperature is raised to the cooking temperature of 150–170° C.

During the displacement with WL, the spent strong black liquor, BLS is discharged from the digester 10 via the pipeline 32 leading in general to the evaporation and the recovery of chemicals. Part of the weak liquors is preferably taken directly to the evaporation plant.

Figure 4:
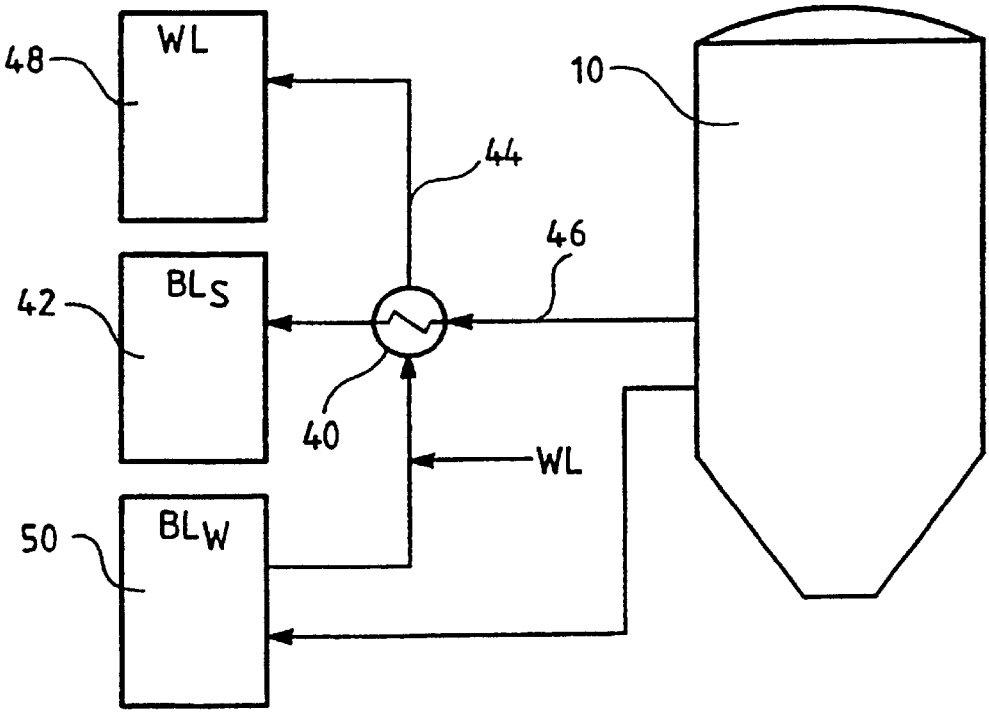
FIG. 4 schematically illustrates a batch cooking process according to a second preferred embodiment of the invention.

In FIG. 4, a preferable arrangement has been presented for the circulation of various liquors. The strong liquor BLS coming from the digester 10 is cooled by means of a heat exchanger 40 in a pipeline 46 upstream of a strong liquor tank 42. In the heat exchanger 40, the heat is transferred to the white liquor WL or to the weak liquor BLW used as a filling liquor, which liquors are then supplied via the pipeline 44 into the white liquor tank 48. Thus, there are three tanks: the strong liquor tank 42, in which the temperature of the liquor BLS is 100–140° C., preferably 120–130° C.; the white liquor tank 48, in which the temperature of the liquor WL is 140–160° C., preferably 145–155° C.; and the weak liquor tank 50, in which the temperature of the liquor is usually below 120° C.

The white liquor WL or weak black liquor BLW or strong black liquor BLS may also be supplemented with dilution liquor having a lower level of dissolved organic material to reduce the concentration of dissolved organic materials throughout the process, as described in the US patents associated with the LO-SOLIDS® cooking process discussed earlier. The concentration of dissolved solids may be reduced by diluting the liquors prior to introducing them to the digester or by extracting liquors having higher dissolved organic material concentrations during the cooking process and introducing dilution liquors, for example, extracting and dilution in the heating circulations commonly associated with batch digesters.

Figure 5:
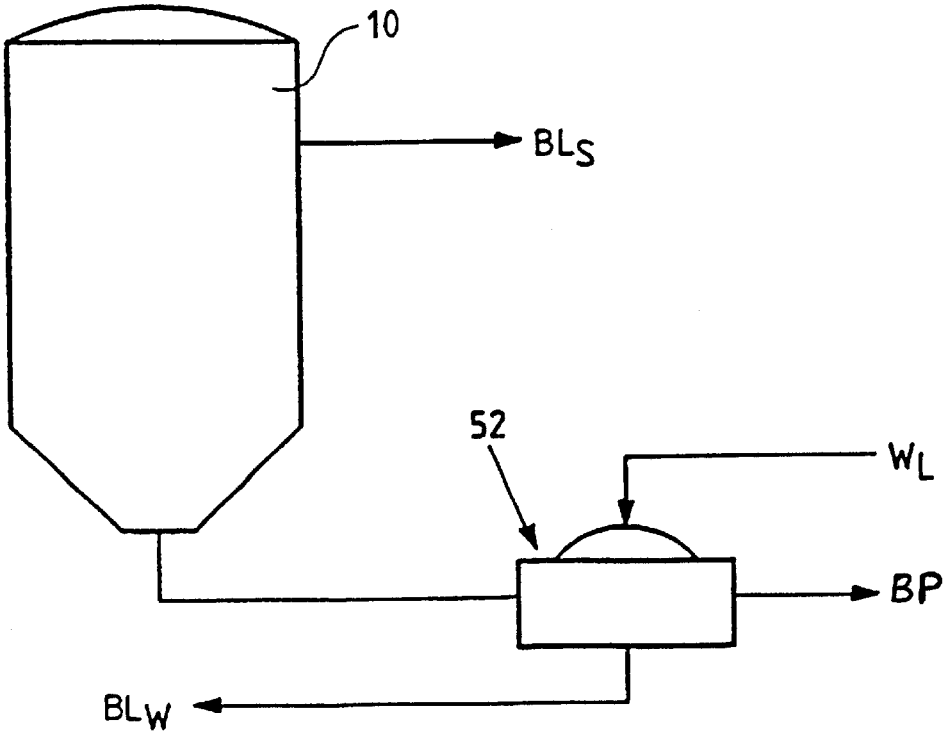
FIG. 5 schematically illustrates a batch cooking process according to a third preferred embodiment of the invention.

In some cases, it may be preferable to perform only a part of the displacement in the digester 10. In the displacement performed in the digester, a strong liquor BLS is produced, which is then directed to the reuse in the pre-treatment of wood matter. As shown in FIG. 5, after such partial displacement, the pulp is removed from the digester 10 and the washing thereof is carried on at the washing department 52, to which also wash liquid WL is brought in addition to pulp, and from which brown stock BP (not shown in FIG. 5) and weak liquor BLW is obtained. Occasionally, also the amount of the weak liquor is small or it is not used at the digester at all. This kind of running method is achieved by using primarily only strong liquor and white liquor during the pre-treatment and cooking. Should additional liquid be needed to adjust the liquid-wood ratio, some spent strong black liquor BLS which has been discharged from the digester after the pretreatment step may be used instead of passing it to the evaporation plant. When a sufficient amount of strong liquor has been recovered, the digester displacement at the end of the cook is interrupted and the cooking is then blown as usual, after which the pulp is washed. Thus, no weak liquor is produced or needed. The expansion steam obtained from the blow is used to heat a liquid or to pre-steam chips in the digester or in a separate expansion vessel. The pre-steaming of chips is preferable in all embodiments of the invention to remove air from the chips and enhance impregnation of the chips with cooking chemicals.

As described above, the pre-treatment of the wood matter has been simplified by the present method and one treatment stage with weak liquor has been eliminated compared to conventional methods. In spite of this, the heat recovery, the sorption of sulphur into wood and the utilization of residual chemicals are still at a high level. The method is thus simpler and more cost-effective compared to conventional methods.

Another advantage is that the bleachability of pulp has improved. The consumption of bleaching chemicals is 10–20% smaller compared to conventional methods. This is because of reduced impurity conditions during the actual cook. In conventional methods, there are 30–50% more of dissolved organic material in the liquid phase during the cook. This increases the consumption of cooking chemicals and deteriorates the bleachability. In the present new method reduced impurity conditions are achieved for two reasons: firstly, a large part of the wood matter is dissolved in the pre-treatment prior to the actual cook, and secondly, white liquor instead of strong liquor is used in the displacement preceding the actual cook.

Thus, we have invented a surprising and simple means to solve the problems of complexity and poor bleachability occurring in conventional cooks.

Many modifications of the new method are possible. One of these is that part (about 20–40%) of the white liquor is added a little later, preferably about 30–60 minutes after the raising of the temperature in the digester to the cooking temperature. In this way, the alkali profile may be somewhat constant during the cook, the yield of the cook being 1–2% better. This is by no means the only modification of the invention, for many other modifications are also possible. In another modification, the liquid flows are adjusted in such a way that weak liquor BLW is not needed, whereby the weak liquor tank 14 may be left out, which further simplifies the process.

Figure 6:
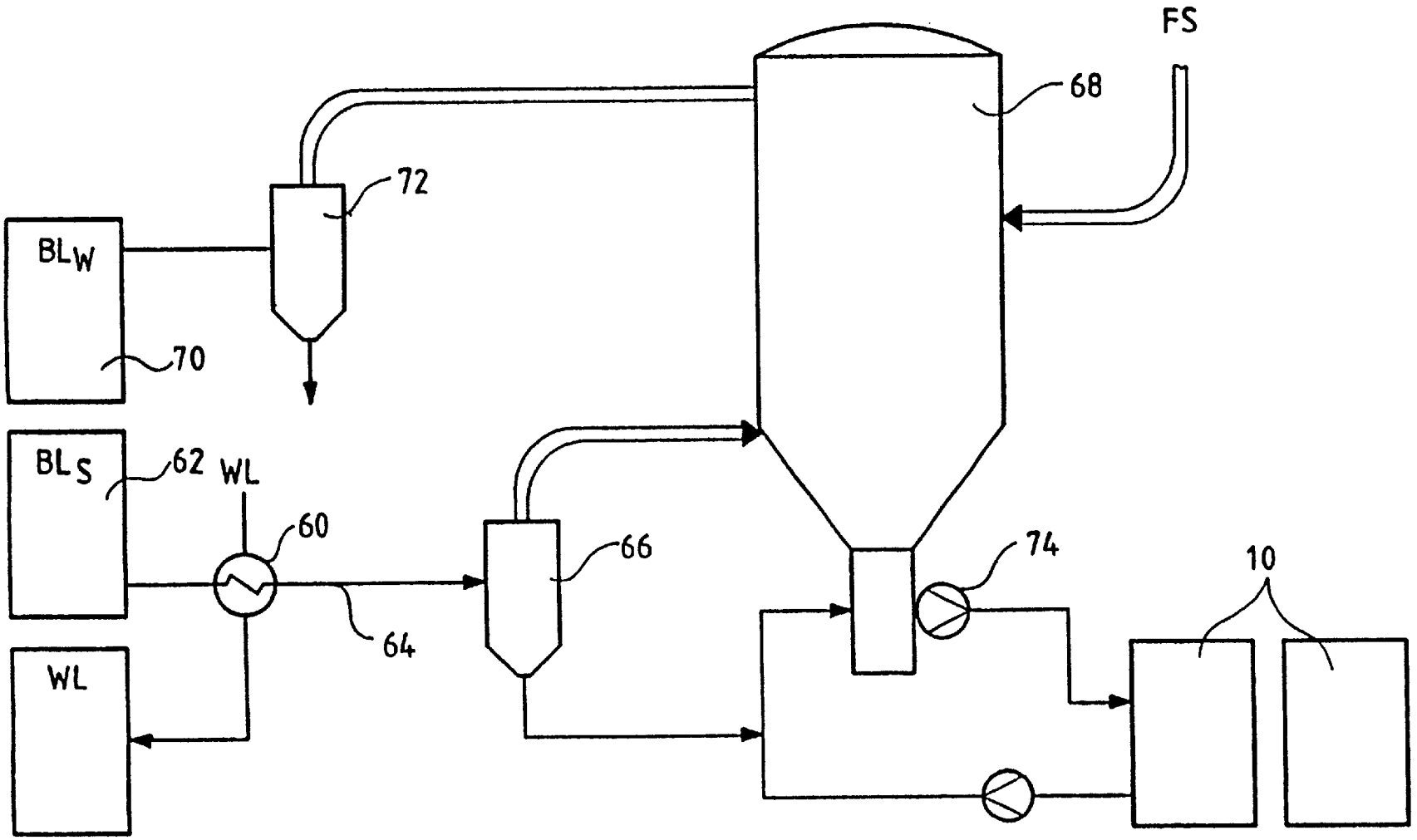
FIG. 6 schematically illustrates a batch cooking process according to a fourth preferred embodiment of the invention.

FIG. 6 illustrates yet another interesting and preferred embodiment. The strong liquor BLS is kept hot in a tank 62. Upstream or downstream of the tank, white liquor is heated by means of the heat exchanger 60 by transferring heat from the strong liquor BLS in the pipe line 64. The heat remaining in the strong liquor BLS is recovered by expanding strong liquor BLS in a flash tank 66, whereby the expansion steam obtained may be used for example for the pre-heating of chips in separate steaming vessels or in a chip hopper 68. Additional steam for the pre-heating of chips can be obtained by expanding weak liquor BLW from a weak liquor tank 70 in a flash tank 72 or by using fresh steam FS. In this way, the chips can be pre-heated and at the same time, air can be removed from the chips, which reduces the problems with soap and foam in the cook.

From the steaming tank 68, which is preferably a Diamondback® steaming tank sold by Ahlstrom Machinery and described in U.S. Pat. Nos. 5,500,083; 5,617,975; and 5,628,873, the chips are preferably transferred by pumping with a pump 74 into the digesters 10. This can be done in the same way as in connection with continuous digesters, for example, by means of a so-called LO-LEVEL® feed system, as described in U.S. Pat. Nos. 5,476,572; 5,622,598; and 5,635,025. In continuous digesters, the chips are pumped into a high pressure feeder, whereas in batch digesters the chips are pumped into the digester itself. This is possible, since the actual pressurization of the digester is performed only later. In the embodiment of FIG. 6, strong liquor BLS is fed to the removal of the steaming vessel 68 in order to facilitate the supply of chips.

EXAMPLE

The cooking tests of pulp relating to our invention were performed in a laboratory, a cooking vessel used having a capacity of 18 liters. Softwood chips, white liquor and black liquor acquired from a pulp mill were used in the tests. After the cook, the pulp, which was still in the form of chips, was washed with tap water and consequently defibered and homogenized. After the screening, the pulp samples were bleached with an ECF sequence DEDED. The chlorine dioxide dose to the first D stage was proportioned to the Kappa number of the unbleached pulp. In other bleaching stages the chemical doses were maintained constant.

Figure 7:
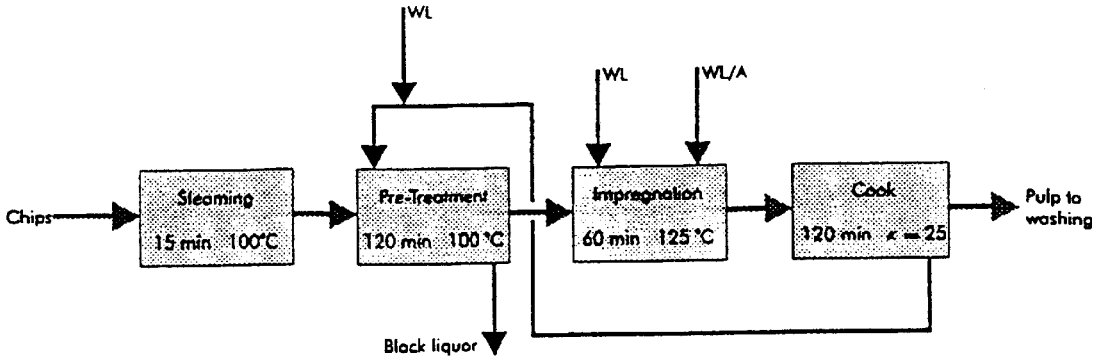
FIG. 7 schematically illustrates the manner of performance of the laboratory tests.

The cook itself was performed in a manner illustrated in FIG. 7 and described in the following. First, 3 kg of dry chips were treated with steam for 15 minutes at a temperature of 100° C. Consequently, the mixture of black and white liquor containing 13% of effective alkali (EA) expressed as NaOH per the amount of wood and having a liquor/wood proportion of 5 was poured into the digester at a room temperature. After a treatment time of 120 minutes at a temperature of 100° C., the EA concentration of the pre-treatment stage dropped to 7–9 g/l expressed as NaOH. After this, the liquid (black liquor BL) was removed from the digester and the impregnation liquor (a mixture of black and white liquor, EA 12%, temperature 120° C.) was added into the digester. The liquid/wood ratio was maintained constant. The duration of the impregnation stage was 60 minutes at a temperature of 125° C.

The steam treatment, pre-treatment and impregnation stages were the same in all cooking methods. Different EA concentrations were tested in the cooking stage by adding alkali (EA 0–25% of the amount of wood) after the impregnation. The treatment times in the pre-treatment and impregnation were relatively long, because a homogeneous starting point had to be ensured for the cooking stage.

Figure 8:
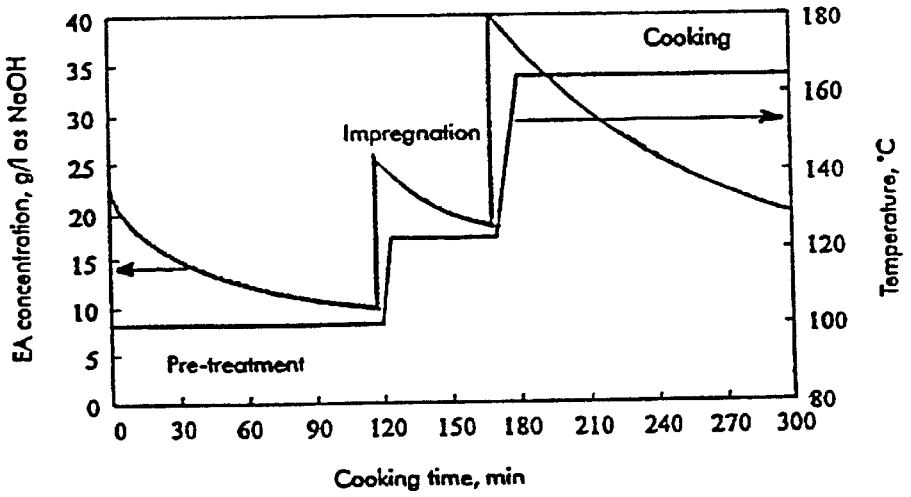
FIG. 8 illustrates the changes in the alkaline profile and temperature used in the tests as a function of the cooking time.

The alkali profile and the temperature profile used in the experiments are illustrated in FIG. 8, which shows that the highest EA concentration was achieved already before the cooking temperature was reached. No alkali was added during the cook itself. The cooking temperature was adjusted in such a way that with different EA concentrations the final Kappa value was 25.

In the following, the results of the performed experiments are described in the light of FIGS. 9–15. The results obtained according to the present invention are compared with a reference laboratory cook having a final EA of 10 g/l, as NaOH. The reference test point is denoted by a square in each of the drawings.

Figure 9:
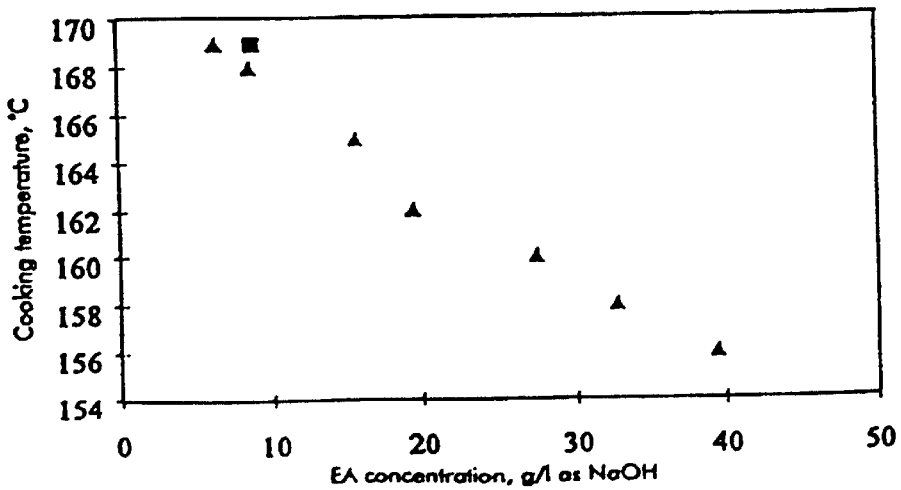
FIG. 9 illustrates how, thanks to the raising of the amount of effective alkali (EA) at the final stage of the cook, a lower cooking temperature is required.

FIG. 9 shows how the amount of effective alkali EA at the final stage of the cook (within the last 0–15 minutes, preferably 0–5 minutes of the cook) affects the cooking temperature so that a lower temperature is required. In the cook having a temperature of 169° C. which we had as a starting point, the amount of effective alkali was at the end of the cook in the order of 10 g/l counted as NaOH. Raising the amount of effective alkali at the final stage of the cook decreases the temperature needed by 13 degrees, i.e. to 156° C. Therefore, it may be concluded that a high alkali concentration at the final stage of the cook removes lignin efficiently, decreasing the Kappa number.

Figure 10:
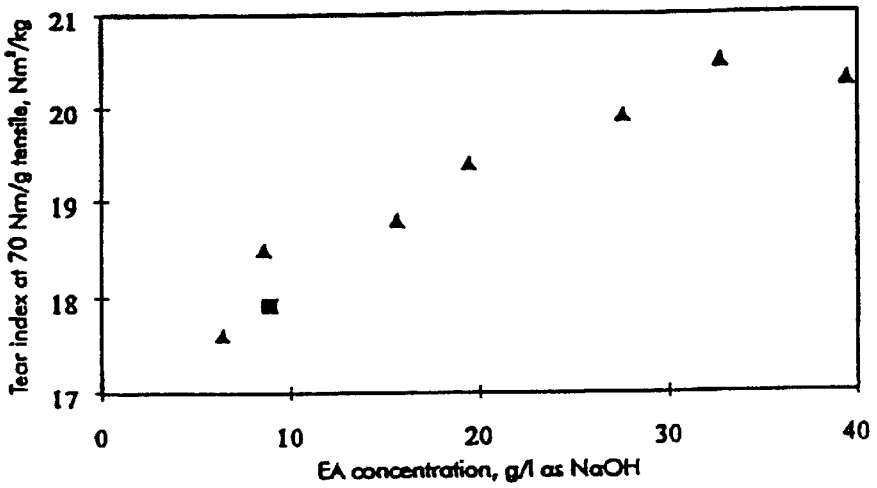
FIGS. 10 and 11 illustrate the tear strength of the brown stock and bleached pulp as a function of the effective alkali at the final stage of the cook.

FIG. 10 illustrates the tear strength of the brown stock as a function of effective alkali at the final stage of the cook. The tear index after the reference cook having an effective alkali concentration of about 10 g/l was about 18, whereas the cook according to the invention always resulted in tear indexes above the reference and typically above 20. In other words, the improvement was approximately 22%.

The strength may be further improved by emptying the digester 10 by means of a discharge pump 22 positioned at the bottom of the digester. This technique is disclosed in more detail in FI patent application 955241. Thus, in one embodiment of this invention, the pulp is discharged from the digester 10 by means of a discharge pump 22 attached preferably to the spherical surface 24 forming the bottom of the digester.

Figure 11:
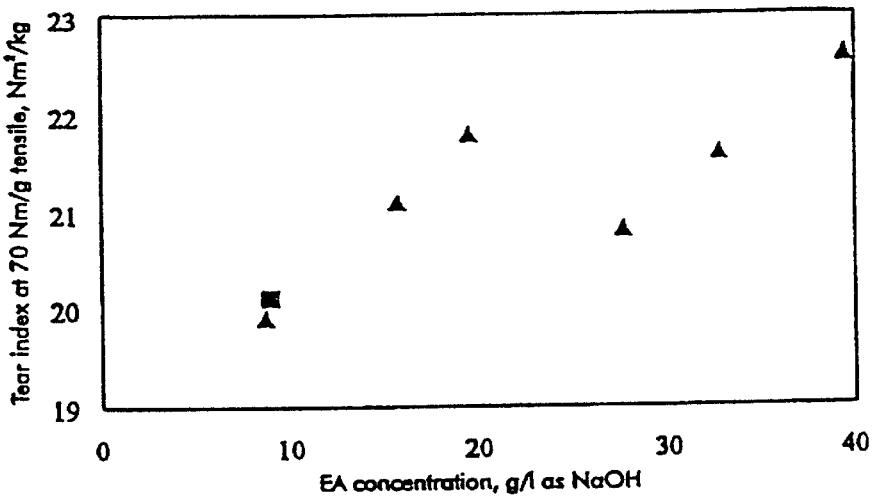

Correspondingly, FIG. 11 illustrates the strength of the bleached pulp as a function of the effective alkali EA of the final stage of the cook. In the reference cook, the tear index was in the order of 20, whereas with a great amount of residual alkali it was higher than 22. In other words, a quite similar improvement was achieved as with brown stock.

Figure 12:
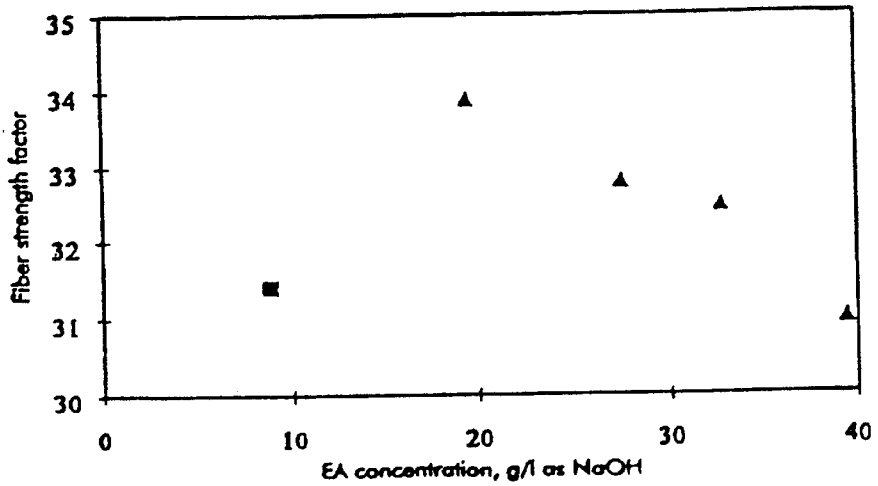
FIGS. 12 and 13 illustrate the fiber strength factors measured from the brown stock and bleached pulp as a function of the effective alkali at the final stage of the cook.
Figure 13:
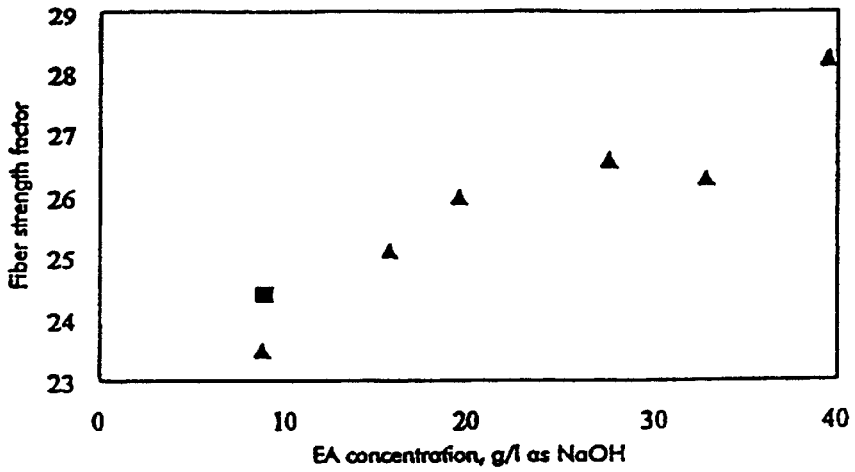

Likewise, FIGS. 12 and 13 illustrate a strength factor of fibers measured from brown stock and bleached pulp. As shown in FIG. 12, in the reference cook, the strength factor of the brown stock was in the order of 31.3, whereas the cook according to our invention resulted in the value of about 34 with the effective alkali amount of 20 g/l. It has to be noted that the residual alkali amount of 40 g/l resulted in fiber strength factors that were in the order of the values of the reference cook. The strength of the pulp produced by the present invention after bleaching with a DEDED sequence was also better than the strength of the bleached pulp produced from conventional methods, as shown in FIG. 13.

Figure 14:
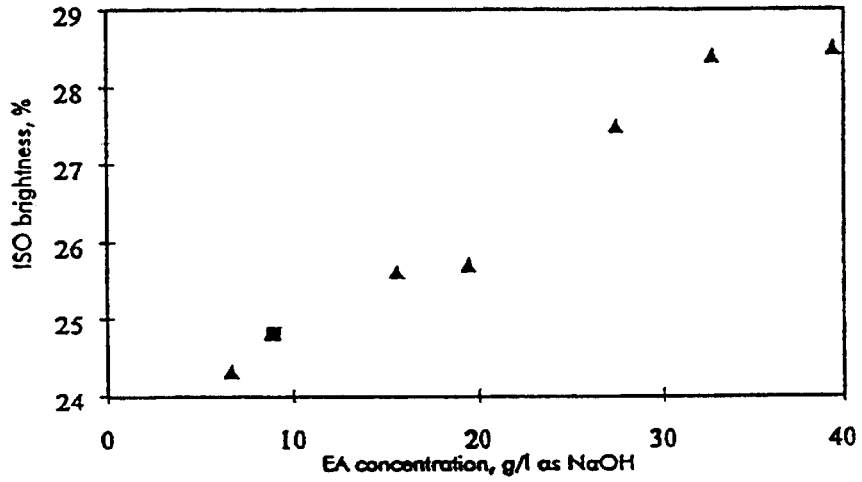
FIG. 14 illustrates the brightness (ISO) of the brown stock as a function of the effective alkali (EA) at the final stage of the cook.

FIG. 14 illustrates the brightness (ISO) of the brown stock as a function of the effective alkali EA at the final stage of the cook. It was observed that as the alkalinity of the final stage of the cook increases, the brightness of the brown stock increases too, which is a clear sign of the improvement of the pulp bleachability.

Figure 15:
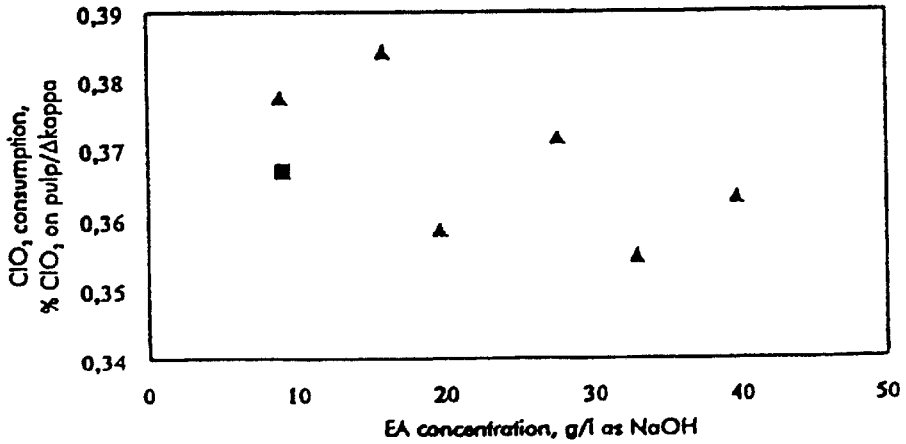
FIG. 15 illustrates the effect of the effective alkali (EA) at the final stage of the cook on the consumption of bleaching chemicals.

FIG. 15 illustrates the effect of the effective alkali EA at the final stage of the cook on the consumption of the bleaching chemicals. It can be concluded that a higher alkalinity at the final stage of the cook decreases the consumption of bleaching chemicals, in other words the process according to our invention has improved the pulp bleachability. On the other hand, it is to be remembered that even small savings in the use of bleaching chemicals will in the long run yield big savings.

As can be seen from the above, by means of our invention it has become possible to improve the conventional Batch process significantly. It has to be noted, however, that only a few most preferred embodiments have been described above, which do, however, disclose all possibilities for improving the batch cooking process to those of ordinary skill in the art.

What is claimed is:

1. A method of cooking comminuted cellulosic fibrous material to produce cellulose pulp in at least one batch digester comprising substantially sequentially:

(a) introducing the material to the digester;

(b) introducing a first liquor having a first effective alkali concentration to the digester;

(c) treating the material in the digester with the first liquor;

(d) displacing first liquor from the digester with a second liquor having a second effective alkali concentration, to produce a third liquor, displaced from the digester, having a third effective alkali concentration lower than the first effective alkali concentration;

(e) treating the material in the digester with the second liquor;

(f) displacing the second liquor from the digester with a fourth liquor having a fourth effective alkali concentration to produce a fifth liquor, displaced from the digester, having a fifth effective alkali concentration, lower than the second effective alkali concentration and between 20–40 g/l, expressed as NaOH; and (g) removing the treated material from the digester; and wherein the fifth liquor comprises at least some of the liquor to be used as the first liquor in (b) for a subsequent batch, and repeating (a)–(g) for the subsequent batch in the same or a different digester.

2. A method as recited in claim 1 wherein (f) is practiced by displacing first and second parts of said second liquor having different alkali concentrations.

3. A method as recited in claim 1 wherein (b)–(f) are practiced so that the fifth liquor has a fifth effective alkali concentration between 20–35 g/l, as NaOH.

4. A method as recited in claim 1 wherein (b)–(f) are practiced so that the fifth effective alkali concentration is between 25–35 g/l, as NaOH.

5. A method as recited in claim 1 wherein the fifth liquor is cooled to a temperature below 140° C. prior to its use as the first liquor in (b).

6. A method as recited in claim 5 further comprising cooling the fifth liquor to a temperature between 80–100° C.

7. A method as recited in claim 6 wherein the fifth liquor is cooled by passing it in heat exchange relationship with a sixth liquor which is cooler than the fifth liquor.

8. A method as recited in claim 7 wherein the sixth liquor used to cool the fifth liquor is white liquor or weak black liquor.

9. A method as recited in claim 1 wherein (f) is practiced using washer filtrate as the fourth liquor.

10. A method as recited in claim 1 wherein (b)–(d) are practiced so that the third effective alkali concentration of the third liquor displaced during (d) is less than 10 g/l, as NaOH.

11. A method as recited in claim 1 wherein (c) is practiced for a duration of between 20–120 minutes.

12. A method as recited in claim 1, further comprising (h), between (f) and (g), displacing a sixth liquor from the digester by the fourth liquor, the sixth liquor having a sixth effective alkali concentration, less than the fifth alkali concentration.

13. A method as recited in claim 12 further comprising using the sixth liquor with the fifth liquor for the first liquor in (b), or with the second liquor of (d), or both.

14. A method as recited in claim 1 further comprising steaming the material between (a) and (b).

15. A method of cooking comminuted cellulosic fibrous material to produce cellulose pulp in at least one batch digester, comprising:

(a) supplying wood material into the digester;

(b) pretreating the wood material in the digester with a first liquor;

(c) displacing the first liquor with a second liquor;

(d) directing the displaced first liquor to a further treatment;

(e) treating the wood material with the second liquor;

(f) displacing the second liquor with a wash liquid to obtain strong black liquor having an alkalinity of 20–40 g/l as NaOH;

(g) removing the digested wood material from the digester; and (h) supplying some of the strong black liquor into the digester at a temperature of below 140° C.

16. A method as recited in claim 15 wherein (f) is practiced by displacing first and second parts of said second liquor having different alkali concentrations.

17. A method as recited in claim 15 wherein (b)–(f) are practiced so that the strong black liquor has an effective alkali concentration between 20–35 g/l, as NaOH.

18. A method as recited in claim 15 wherein (b)–(f) are practiced so that the effective alkali concentration of the strong black liquor is between 25–35 g/l, as NaOH.

19. A method as recited in clam 15 further comprising cooling the strong black liquor to a temperature below 130° C. prior to its use as the first liquor in (b).

20. A method as recited in claim 19 wherein the cooling step is practiced so that the strong black liquor is cooled to a temperature between 80–100° C.

21. A method as recited in claim 19 wherein the strong black liquor is cooled by passing it in heat exchange relationship with a sixth, cooler, liquor.

22. A method as recited in claim 21 wherein the cooling step is practiced using white liquor or weak black liquor as the sixth liquor.

23. A method as recited in claim 15 wherein (f) is practiced using washer filtrate as the wash liquid.

24. A method as recited in claim 15 wherein (b) and (c) are practiced so that the effective alkali concentration of the liquor displaced during the practice of (c) is less than 10 g/l, as NaOH.

25. A method as recited in claim 15 wherein (b) is practiced so that it has a duration of between 20–120 minutes.

26. A method as recited in claim 15 further including (h), between (f) and (g) displacing a weak black liquor from the digester with wash liquid, the weak black liquor having an effective alkali concentration less than the alkali concentration of the strong black liquor.

27. A method as recited in claim 26 further comprising using the weak black liquor from (h) with the strong black liquor as at least one of the first liquor in (b), and the second liquor of (e), in a subsequent batch in the same or a different digester.

28. A method as recited in claim 15 further comprising steaming the material between (a) and (b).

* * * * *